United States Patent [19]

Musil

[11] 4,422,848

[45] Dec. 27, 1983

[54] HEAT SHIELDS FOR DRUM AGGREGATE DRIERS AND ASPHALTIC DRUM MIXERS

[75] Inventor: Joseph E. Musil, Ely, Iowa

[73] Assignee: Iowa Manufacturing Company of Cedar Rapids, Iowa, Cedar Rapids, Iowa

[21] Appl. No.: 344,208

[22] Filed: Jan. 29, 1982

[51] Int. Cl.[3] ..... F27B 7/14; F27D 3/00

[52] U.S. Cl. ..... 432/118; 432/245

[58] Field of Search ..... 432/65, 118, 245

[56] References Cited

U.S. PATENT DOCUMENTS 3,910,756 10/1975 Henning ..... 432/118

4,300,837 11/1981 Malbrunot ..... 432/118

FOREIGN PATENT DOCUMENTS 420997 2/1978 U.S.S.R. ..... 432/118

*Primary Examiner*—John J. Camby

*Attorney, Agent, or Firm*—Simmons, Perrine, Albright & Ellwood

[57] ABSTRACT

A drum aggregate drier and a drum mixer for making asphaltic concrete feature heat shields between circumferentially adjacent flights inside the drum along the radiant zone of the burner flame in order to minimize drum overheating, heat loss and drum wall wear.

1 Claim, 4 Drawing Figures

HEAT SHIELDS FOR DRUM AGGREGATE DRIERS AND ASPHALTIC DRUM MIXERS

BACKGROUND OF THE INVENTION

The drum used, for example, with a batch-type asphalt plant as an aggregate drier or as a mixer for making asphaltic concrete, is subject to very high temperatures in the area where the burner flame enters the drum for drying the virgin aggregate. Typical drum surface temperatures in this area may be 650° to 750° F. or so which is destructive to the drum itself as well as wasting heat by virtue of radiation from the drum wall. When a drum mixer is used for recycling used asphaltic concrete, in which the latter is introduced midway or so down the drum, the wall temperatures of the upstream portion of the drum are usually even higher, 750° to 850° F. or so, since less virgin aggregate is introduced adjacent the burner. The chief object of the present invention is to reduce that heat loss and the concomitant deleterious heating of the drum wall.

SUMMARY OF THE INVENTION

It has been discovered that if "heat shields" are placed between those flights about the interior of the drum in the vicinity of the "radiant zone" of the flame, remarkable reductions in outer wall temperatures are achieved. For instance, when the drum is used with virgin aggregate, either as a drier only or as a mixer in which liquid asphalt is also added to the dried aggregate, the wall temperature in the area concerned is reduced to 350° to 450° F. or so, and when used to recycle old asphalt pavement, to 400° to 500° F. or so. These temperature reductions not only diminish the heat loss by radiation from the drum and prolong its life, but also increase its thermal efficiency since the heat shields revert heat back into the drum and the virgin aggregate by reflection and conduction. Another advantage of the heat shields is the reduced wear on the drum itself from the virgin aggregate.

Preferably, each heat shield is simply a rectangular plate secured along one edge beneath an adjacent flight, the remainder of the plate being bent so that it is both spaced from the drum wall and spans the circumferential interval between two flights.

DETAILED DESCRIPTION OF THE PREFERRED EMBODIMENT

Figure 1:
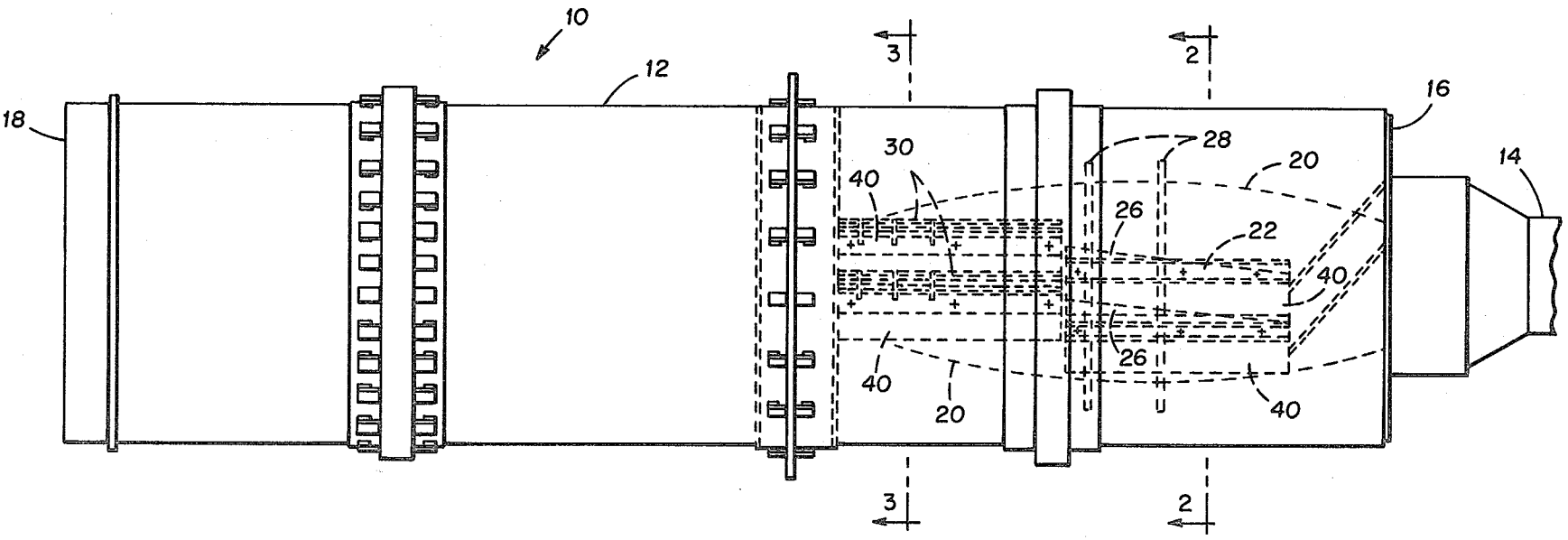
FIG. 1 illustrates in side elevation the drum of a typical drum drier or mixer, a pair of each of two sets of flights in the radiant zone of the burner flame and fitted with the heat shields of the invention being indicated by broken lines.

The drum 10 of a typical drum drier or drum mixer consists essentially of a cylindrical shell 12 having a burner 14 discharging axially into the drum at 16 which is the upstream end of the latter with respect to flame direction. As previously noted the drum 10 can be simply a drier for the aggregate which is introduced in any of well-known ways (not shown) at the upstream end 16 in the case of a parallel flow drier or through the drum downstream end 18 in the case of a counterflow drier, and then transferred from the drum to a batch-type asphalt plant. Or the drum 10 can be a mixer in which, further downstream, liquid asphalt is added to the dried aggregate to produce all new asphaltic concrete, or alternately a mixer in which some recycled asphaltic pavement is added to the dried virgin aggregate as well as fresh liquid asphalt. Each of these types of drums is well known so that their details and operation need not be further described.

Figure 2:
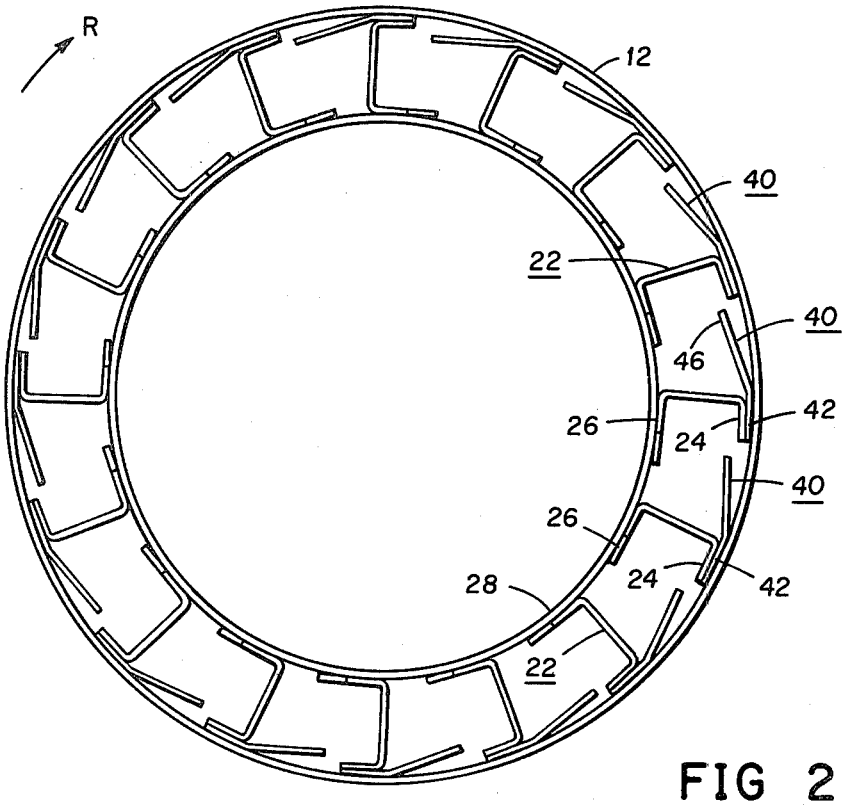
FIGS. 2 and 3 are sectional views taken along the lines 2—2 and 3—3 of FIG. 1, sectional hatching, however, being omitted in the interest of better clarity.
Figure 3:
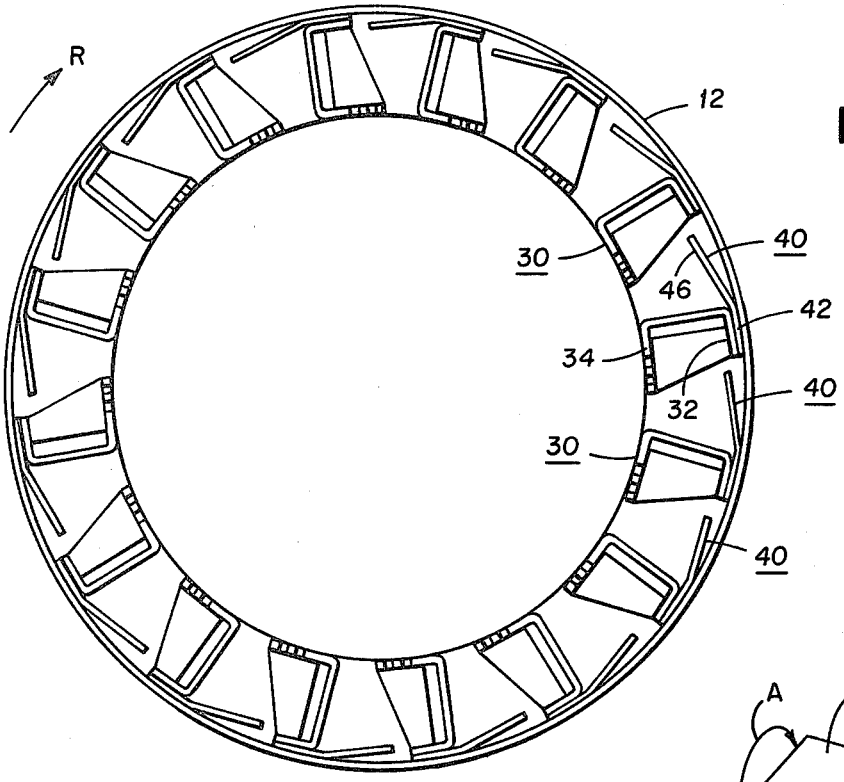

Typical of all these drums are groups or sets of flights about the interior of the shell 12 for cascading the virgin aggregate in a veil across the flame of the burner 14. The sets of flights are arranged axially of the shell 12 and, as noted, the location of two of those sets adjacent the upstream end 16 are indicated in FIG. 1. This is the area of the shell 12 concerned because those flights embrace the "radiant zone", indicated at 20, of the flame from the burner 14. The first set of flights, generally indicated at 22, consists of circumferentially spaced troughs extending axially of the shell 12 and disposed as shown in FIG. 2 with respect to the direction of drum rotation R. Each flight 22 includes a mounting flange 24 and a tapered lip 26 which increases in height (see FIG. 1) toward the drum downstream end 18, the lips 26 being braced by a pair of spaced annular rims 28 (see FIGS. 1 and 2). The second set of flights, of the "basket" type, are generally indicated at 30 and also consists of circumferentially spaced troughs extending axially of the shell 12 and similarly disposed as shown in FIG. 3 with respect to the direction of drum rotation R. Each flight 30 also includes a mounting flange 32 and a gridded lip 34.

Figure 4:
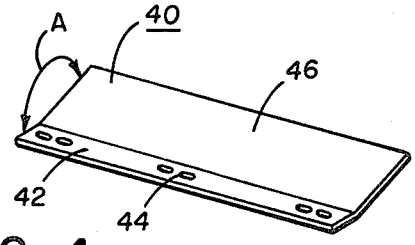
FIG. 4 is a perspective view of one of the heat shields of the invention.

The heat shields 40 (see FIG. 4) each consists of a rectangular plate of an overall length equal to the flights 22 or 30 with which it is used. One of its long edges serves as a mounting flange 42 and is provided with suitable mounting holes 44 while the remainder of the plate is bent at an obtuse angle A to form a heat reflecting panel 46 of a width approximately equal to the circumferential distance between the flights 22 or 30, as the case may be. The shield mounting flanges 42 are sandwiched between the flight mounting flanges 24 and 32 and the inner wall of the shell 12, being secured together to the latter by bolts (not shown) through the three parts, as indicated by "+'s" in FIG. 1, so that the reflecting panels 46 are both spaced from the inner wall of the shell 12 and span nearly the entire distance between adjacent flights 22 and 30, as shown in FIGS. 2 and 3. As the shields 40 wear or disintegrate owing to the heat of the flame 20 they (and the flights 20 and 30 for the same reason) can be readily replaced by removing their securing bolts, thus saving wear and tear on the shell 12 in a vulnerable area as earlier explained.

It will be apparent, of course, that the number of heat shields is not necessarily dependent upon the number of sets of flights. The important thing is that they circumscribe the radiant zone of burner flame. Thus if only one set of longer flights were used in that zone only one set of longer heat shields would be needed. And conversely, if three or more sets of shorter flights were used, three or more sets of shorter heat shields would be called for. Hence, though the present invention has been described in terms of a particular embodiment, being the best mode known of carrying out the invention it is not limited to that embodiment alone. Instead the following claims are to be read as encompassing all adaptations and modifications of the invention falling within its spirit and scope.

I claim:

1. In apparatus of the kind described including a cylindrical shell and burner means disposed adjacent one end of the shell, the burner means discharging a flame of hot gases axially into the shell from said end, and a set of flights extending axially of the shell and spaced circumferentially about the inner wall of the shell, the improvement comprising: a set of heat shields extending axially of the shell and disposed between respective ones of the flights in spaced relation to the inner wall of the shell effective to shield the wall of the shell between the flights from the radiant zone of the flame, each heat shield comprising an essentially rectangular plate having opposite edge portions extending axially of the shell, one of the edge portions being planar and sandwiched between one flight and the inner wall of the shell, the remainder of the heat shield being also planar and bent at an obtuse included angle relative to said one portion effective so that the spacing between the inner wall of the shell and said remainder of the heat shield progressively increases toward and is a maximum at the other edge portion, said other edge portion lying close to an adjacent flight but unsecured thereto.

* * * * *